US011371391B2

(12) United States Patent
Le Gall

(10) Patent No.: US 11,371,391 B2
(45) Date of Patent: Jun. 28, 2022

(54) DEVICE FOR ASSEMBLING A TURBINE ENGINE AND PROCEDURE USING SAID DEVICE

(71) Applicant: SAFRAN AIRCRAFT ENGINES, Paris (FR)

(72) Inventor: Remy Le Gall, Chelles (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/020,935

(22) Filed: Jun. 27, 2018

(65) Prior Publication Data

US 2019/0003340 A1 Jan. 3, 2019

(30) Foreign Application Priority Data

Jun. 28, 2017 (FR) ..... 1755937

(51) Int. Cl.
*F01D 25/28* (2006.01)
*F01D 25/16* (2006.01)
*F01D 5/02* (2006.01)

(52) U.S. Cl.
CPC ..... *F01D 25/285* (2013.01); *F01D 5/026* (2013.01); *F01D 25/16* (2013.01);
(Continued)

(58) Field of Classification Search
CPC ..... F01D 25/285; F01D 25/16; F01D 5/026; F01D 25/24; F01D 21/003;
(Continued)

(56) References Cited

U.S. PATENT DOCUMENTS 2,702,947 A * 3/1955 Dreier ..... G01C 9/34 33/387
3,688,485 A * 9/1972 Lancaster ..... D01H 7/08 57/1 R (Continued)

FOREIGN PATENT DOCUMENTS

EP 2955339 A1 * 12/2015 ..... F01D 25/285
FR 2644843 A1 9/1990
FR 2890110 A1 3/2007

OTHER PUBLICATIONS

Preliminary Research Report and Written Opinion received for French Application No. 1755937, dated Mar. 9, 2018, 8 pages (1 page of French Translation CoverSheet and 7 pages of original document).

*Primary Examiner* — Lee A Holly
(74) *Attorney, Agent, or Firm* — Womble Bond Dickinson (US) LLP

(57) ABSTRACT

The invention concerns a device for assembling a turbine engine, intended to centre a shaft of a second module relative to a longitudinal axis (X) of a trunnion for a first module, the shaft having to be inserted along said longitudinal axis (X) via one end of the trunnion, wherein it includes a holding ring configured to be fixed around trunnion by tightening in such a way as to have a central axis of holding ring coincide with the longitudinal axis of the trunnion, and a means of measurement, supported by holding ring and configured to measure the position of an outer surface of the shaft along a radial direction relative to the central axis of the ring on a transverse plane (P) offset from holding ring, in such a way as to be located in front of the end of the trunnion when the device is installed on the trunnion. The invention also concerns the assembly formed by the device and a calibration model, along with an assembly procedure that uses same.

13 Claims, 3 Drawing Sheets

(52) U.S. Cl.
CPC .... *F05D 2230/64* (2013.01); *F05D 2230/644* (2013.01); *F05D 2230/68* (2013.01); *F05D 2240/60* (2013.01)

(58) Field of Classification Search
CPC ..... F05D 2230/644; F05D 2230/68; F05D 2240/60; F05D 2230/64; G01B 5/252; G01B 5/25; G01B 5/0002; F16B 7/0486; D01H 7/08; F04D 29/522; G01C 9/34; G01M 13/02
See application file for complete search history.

(56) References Cited

U.S. PATENT DOCUMENTS 3,942,253 A * 3/1976 Gebel ..... G01B 5/201 33/555.1
4,548,546 A * 10/1985 Lardellier ..... F01D 21/003 33/543
4,709,485 A * 12/1987 Bowman ..... G01B 11/272 33/228
4,964,224 A * 10/1990 Jackson ..... G01B 5/0002 33/412
6,058,767 A * 5/2000 Calvin ..... G01M 13/04 73/115.06
6,519,865 B1 * 2/2003 Yelverton ..... G01B 5/252 33/533
2007/0014660 A1 * 1/2007 Lee ..... G01M 13/02 415/122.1
2007/0044307 A1 * 3/2007 Bergerot ..... F01D 5/026 29/889.2
2013/0326890 A1 * 12/2013 Alexander ..... G01B 5/25 33/645
2015/0144760 A1 * 5/2015 Paradiso ..... F16M 13/022 248/534
2015/0300529 A1 * 10/2015 Lavalley ..... F16L 1/06 405/184.5
2017/0107858 A1 * 4/2017 Murphy ..... B25H 1/0007

* cited by examiner

DEVICE FOR ASSEMBLING A TURBINE ENGINE AND PROCEDURE USING SAID DEVICE

FIELD OF THE INVENTION

The present invention concerns the field of turbo machines and multi-body gas turbine engines, in particular. It concerns engine assembly operations and, in particular, the assembly of the low-pressure turbine module on a high-pressure body.

STATE OF THE ART

A double-body turboreactor, with a front blower, for example, comprises a high-pressure body HP and a low-pressure body LP. The LP body rotates at a first speed and comprises an LP turbine downstream from the HP body, which drives the front blower. The HP body rotates at a different speed to the LP turbine. The shafts for the two bodies are concentric and the shaft for the LP body passes inside the shaft for the HP body. The shaft of the LP body is guided as it rotates by bearings that are supported by the fixed structure of the engine, respectively located downstream of the turbine and upstream of the high-pressure compressor. The shaft of the HP body is guided as it rotates by bearings that are supported by the fixed structure of the engine upstream and by the shaft of the LP body downstream, via an inter-shaft bearing. This bearing is a roller bearing and is placed, at least according to a known engine, between the high-pressure turbine and the low-pressure turbine. Such a bearing comprises an inner ring equipped with rollers held in place by a cage on the shaft of the LP body and an outer ring, usually mounted in the shaft of the HP body by cold tightening. The mounting of the bearing, i.e. the assembly of the outer ring with the assembly formed by the rollers, the cage and the inner ring, is carried out at the same time as the docking of the low-pressure turbine, during which the shaft, previously assembled with the low-pressure turbine, is guided into the HP body. By "docking", we mean all or part of the translation of the low-pressure turbine module until its outer carter clamp comes into contact with the corresponding clamp on the module that forms the HP body.

The mounting of the inter-shaft bearing is therefore a blind operation. The operator has no visibility in order to observe, in particular, the rollers engaging with the rotor of the HP body and then the outer ring. This operation comprises considerable risk of degradation of the bearing if the conditions are not controlled. The most significant risk for the bearing is hard contact between the rollers and the holding bolt for the outer ring and the ring itself.

The use of techniques is known, from document FR-A1-2890110 for example, for heating the part that supports the outer ring in a controlled manner, in order to facilitate the contact-free insertion of the rollers.

However, even with the dilation of the outer ring, the precise positioning of the shaft of the LP body must be ensured in order to avoid any contact. The known practice of centring the shaft of the LP body using a rule lacks precision and causes assembly incidents that may lead to lack of quality or even the degradation of parts that will then need to be changed by dismantling the modules of the assembled turbine engine, at least partially. Document FR-A1-2890110, proposes that laser measurements be used with instruments mounted onto a removable support that is positioned relative to the HP body but the instrumentation is costly and its use is complex.

There is therefore a need for a simple technique for positioning the shaft of the LP module relative to the outer ring of the HP body module with sufficient precision to minimise the risk of hard contact with the components of the inter-shaft bearing.

The prior art also comprises documents U.S. Pat. No. 4,548,546 and FR-A1-2644843.

DESCRIPTION OF THE INVENTION

To this end the invention concerns a device for assembling a turbine engine, intended to centre a shaft of a second module relative to a longitudinal axis of a trunnion for a first module, said shaft having to be inserted along said longitudinal axis via one end of said trunnion, characterised in that it comprises a holding ring configured to be fixed around the trunnion by tightening in such a way as to have a central axis of the holding ring line up with the longitudinal axis of the trunnion, and a means of measurement, supported by the holding ring and configured to measure the position of an outer surface of said shaft along a radial direction relative to the central axis of the ring on a transverse plane, offset from holding ring, in such a way as to be located in front of said end of the trunnion when the device is installed on the trunnion.

The device described provides an easy way to hold the measuring means on the trunnion using the holding ring. This provides a direct centring measurement relative to the trunnion and allows a good level of precision to be obtained, typically down to one-hundredth of a millimetre, using conventional means of measurement. The use of laser measuring devices, in particular, may be avoided.

In the above case, the first module is the high-pressure body and the second module is the low-pressure turbine module. However, the device described may be used in other cases, the trunnion may be a hollow, fixed or rotating part that forms the support for an outer bearing ring in which the shaft must rotate. The centring precision obtained using the device allows hard contact with the outer ring to be avoided when it has been previously dilated.

The measuring means advantageously comprises a mobile part in said radial direction, which is equipped to come into contact with an outer surface of the shaft and a measuring unit for the radial position of said part.

This assembly takes a tactile measurement of the position of the shaft along the radial direction, which is simple to implement.

The device preferably comprises a fitted means to switch the mobile part from a first position in which the part moves along the radial direction, intended to carry out the measurement, and a second position in which said part is distanced from the central axis so as to allow the shaft to pass.

The device advantageously comprises a positioning means to align said radial direction based on a vertical.

Given the geometry and the weight of the modules of the turbine engine, it is the centring based on the vertical which is the most critical. This centring may therefore be checked as a priority.

The holding ring advantageously comprises at least two parts that move in relation to each other, in such a way as to be able to install or remove the device from the trunnion laterally, for example when the shaft is engaged in the trunnion.

This allows device to be manipulated even though, on the one hand, the assembly zone in which the measurement device is installed is overcrowded and, on the other hand, it is no longer possible to disengage the device longitudinally from the trunnion when the modules are being assembled.

The device preferably comprises a reproducible tightening means for said moving parts on the holding ring, in such a way as to control the position of the holding ring relative to the trunnion.

The invention also concerns an assembly formed of such a device and a calibration model comprising a first part that reproduces the geometry of the outer surface of the trunnion and a second part that reproduces the geometry of an outer surface of a cylindrical portion of the shaft, centred relative to the longitudinal axis of the first part.

In this way, it is possible to obtain a precise reference measurement for the shaft as it should be installed in the trunnion by installing the device on the model and measuring the position of the second part of the model. This reference position may then be used to position the shaft, since the device is installed on the trunnion.

The invention also concerns a procedure for assembling a turbine engine, the turbine engine comprising at least a first module with a trunnion and at least a second module with a shaft, the shaft and the trunnion being designed to be connected via a bearing comprising an outer ring mounted inside of the trunnion and an inner ring mounted around the shaft, comprising the following steps to insert the shaft of the second module inside the trunnion via one extremity of the latter:

docking of the second module with the first module until the shaft is positioned at a set distance from the trunnion;

centring of the shaft relative to the trunnion;

dilation of the outer ring by heating the trunnion;

finalisation of the docking of the second module, in such a way that the inner ring aligns with the outer ring to form the bearing;

characterised in that the centring step itself comprises at least one fine centring operation during which the vertical position of the shaft is adjusted relative to a vertical reference position using a device as described above.

As stated above, the modules may be different to those described in the introduction and the trunnion may be a fixed or rotating part. The fine centring along the vertical is especially critical owing to the geometry and the weight of the modules. What is more, this fine centring operation may be advantageously preceded by a preliminary centring operation, using conventional means, such as a rule, for example. This preliminary centring operation causes the fine vertical centring to reach its objective of correctly centring the shaft in order to then allow the rollers and the inner ring to be inserted into the outer ring that has been previously dilated by heating without any there being any contact.

The vertical position of the shaft is advantageously measured by the device on at least a part of the shaft located between the inner ring and the outer ring when one end of the shaft has been inserted into the trunnion.

The procedure preferably comprises a step for adjusting said device on a calibration model in such a way as to determine the vertical reference position of the shaft relative to the device when it is installed on the trunnion.

This calibration step allows a high level of precision to be obtained on centring of the shaft relative to the trunnion, down to the hundredth of a millimetre.

BRIEF DESCRIPTION OF THE FIGURES

The present invention shall be better understood and other details, characteristics and advantages of the present invention shall become clearer on reading of the following description of a non-restrictive example, with reference to the attached drawings in which.

DESCRIPTION OF SEVERAL EMBODIMENTS

Figure 1:
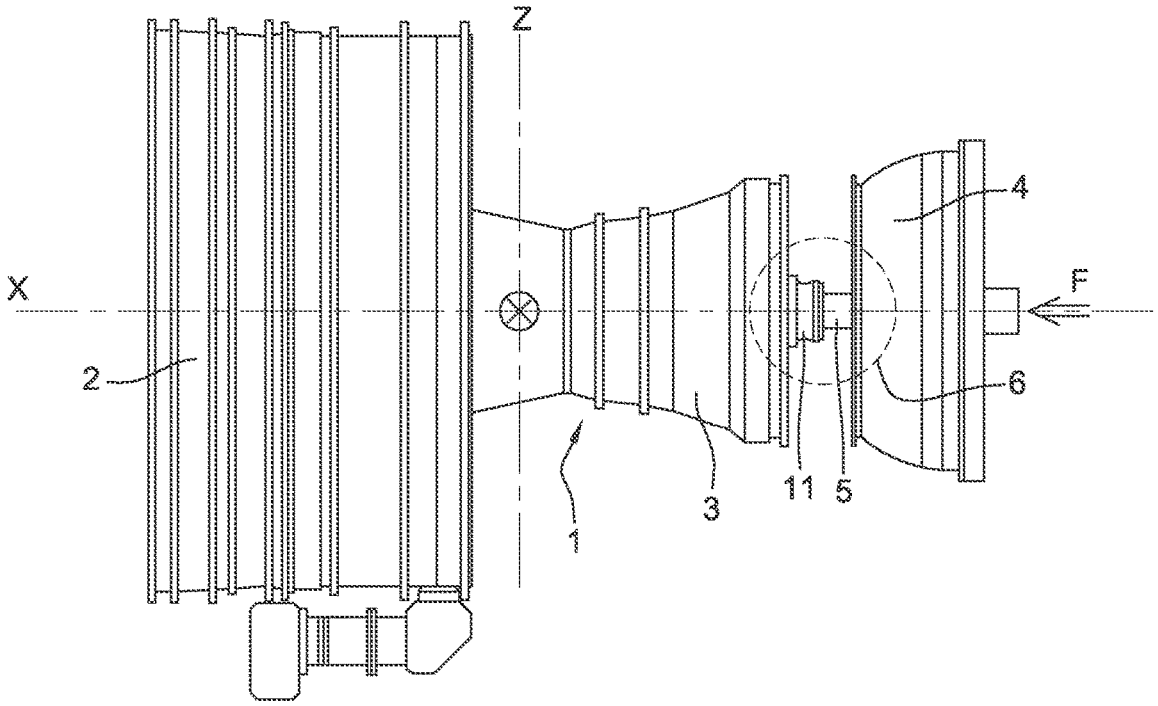
FIG. 1 shows a turbine engine during assembly.

FIG. 1 shows a turbine engine 1 during assembly, at the start of the docking operation defined above. This is a double-flow, double-body turbine engine. It comprises one front blower 2 and one module 3, called "first module", formed from the high-pressure body with its shaft, called "first shaft", not shown in FIG. 1. These parts are already assembled. Low pressure turbine module 4, the second module, is being mounted here, with its shaft 5, the second shaft must be inserted into the high-pressure body following arrow F, parallel to the longitudinal axis X of first module 3. This longitudinal axis X is horizontal during assembly. The critical zone is located in zone 6 of the inter-shaft bearing, which is normally located inside trunnion 11 on high pressure body 3. The visibility in this zone is zero during assembly.

The mounting of second module 4, the low-pressure turbine module, in first module 3, the high-pressure body, is therefore described in the rest of the description. Upstream and downstream are noted relative to longitudinal axis X, in accordance with the main direction of the flow of gas and therefore moving from the high-pressure body to the low-pressure turbine.

Figure 2:
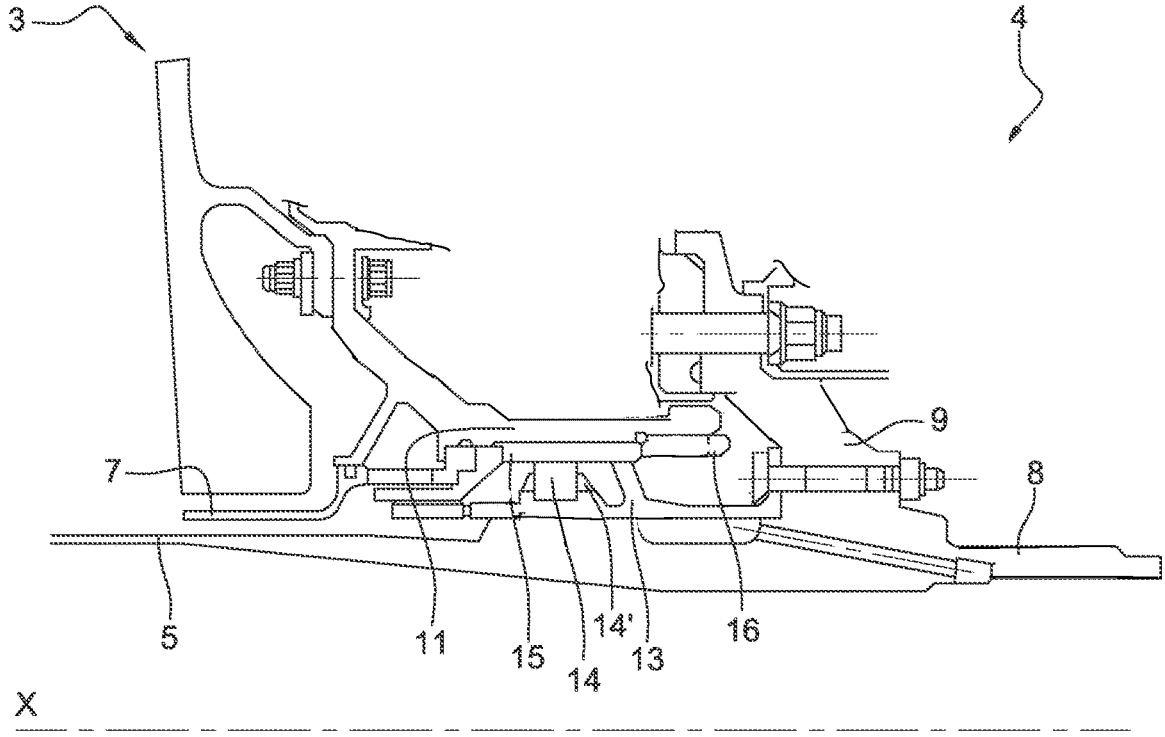
FIG. 2 shows the detail of the inter-shaft bearing after assembly.

FIG. 2 shows the critical zone after assembly in more detail. The first shaft, on high pressure body 3, is extended with a trunnion 11 at its downstream end. The longitudinal axis X of first module 3 is also the axis of symmetry of trunnion 11 and the first shaft. Here, a collar 7 of the first shaft is located on the upstream part of trunnion 11 in the figure. The internal diameter of trunnion 11 is greater than that for collar 7. We see only a part of the high-pressure body turbine 3.

Second shaft 5 is engaged in high pressure body 3 and passes through collar 7. Second shaft 5 comprises a trunnion 8 on its end, on the right-hand side on the Figure, for mounting a bearing which may be intended, as stated in the introduction, to guide second shaft 5 relative to the fixed structure of the turbine engine. Radial clamp 9 allows the different parts that form the moving part of low pressure turbine 4 to be mounted.

The inter-shaft bearing, known in itself, comprises an inner ring 13, attached to second shaft 5 using the bearing elements, such as rollers 14, for which the 14' cage is tightened onto inner ring 13. Outer ring 15 is mounted here, cold-tightened inside trunnion 11. It is advantageously locked in place by a bolt 16. When the inter-shaft bearing is correctly assembled, as shown in FIG. 2, rollers 14 are in contact with outer ring 15 and inner ring 13 in such a way that they can roll freely on their surfaces.

Figure 3A:
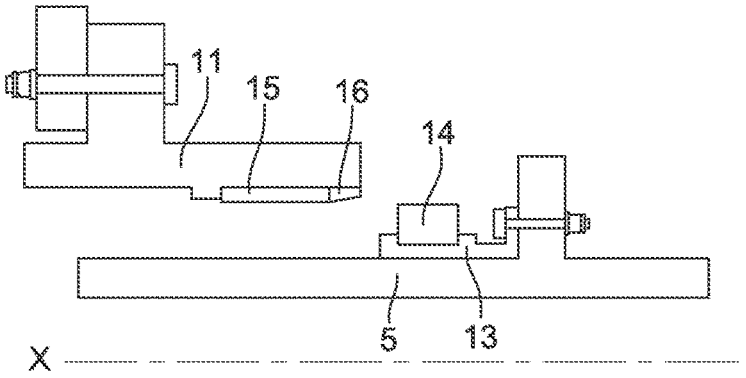
FIG. 3*a* shows a schematic representation of the same area as FIG. 2 before assembly, with the parts positioned correctly.

FIG. 3*a* shows a schematic representation of the main parts of zone 6 of the inter-shaft bearing before assembly, when shaft 5 of second module 4 is correctly aligned with the X axis of first module 3.

The assembly is then carried out by translating second module 4 along the axis X toward the left on FIG. 3*a*, after dilation by heating of the assembly formed from trunnion 11 and outer ring 15, with first module 3 being fixed. After cooling, rollers 14 are in contact with the cylindrical surfaces of inner rings 13 and outer rings 15, in such a way that they roll freely over same.

Figure 3B:
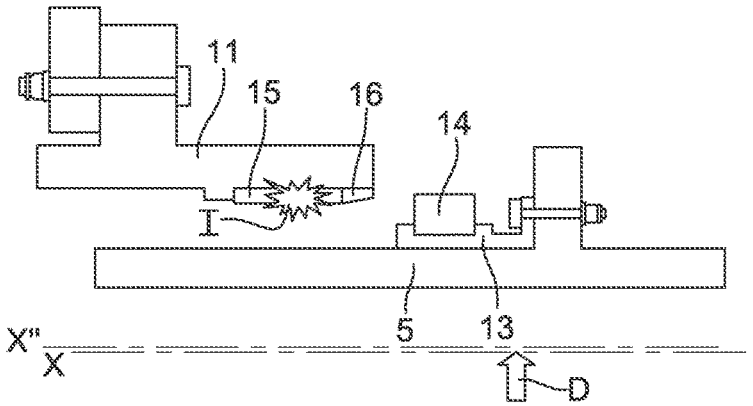
FIG. 3*b* shows a schematic representation of the same area as FIG. 2 before assembly, with the parts positioned incorrectly.

We understand that owing to the low tolerances, there is a significant risk of contact between parts 15, 16 and 14 of the inter-shaft bearing. This hard contact may cause scratches, gouges or the first steps of peeling, which are likely to damage the integrity of the bearing. FIG. 3*b* illustrates such a case. A slight offset of axis X" of shaft 5 relative to the axis X of first module 3, represented by arrow D, may cause hard contact, on movement, at point I, even if outer ring 15 was previously dilated by heating.

The applicant company has perfected a procedure and instrumentation allowing for the safe assembly of the low-pressure module in this environment and the present application incorporates elements from application FR-A1-2890110 as examples. The aim of the present application concerns, more specifically, a step that precisely centres second shaft 5 relative to trunnion 11 and a tool that has been adapted to eliminate the risks of contact on outer ring 15 or its fixing bolt 16 on transition from the state in FIG. 2 to that in FIG. 3.

It is known that the assembly instrumentation for the turbine engine comprises a mount that holds in place first module 3 and a mobile support that holds in place second module 4. These items, which are in themselves known, are not shown on the figures. The mount holds first module 3 in place, ensuring the horizontal orientation of longitudinal axis X. The moving support allows second module 4, formed from the low-pressure turbine with second shaft 5 to be moved along the three directions, X, Y and Z, represented in FIG. 1. The moving support also allows second module 3 to be rotated easily around the vertical axis Z, in such a way as to present the upstream end of second shaft 5 inside the downstream end of the first shaft and insert it into collar 7.

It is also known, for example, with reference to application FR-A1-2890110, that the instrumentation comprises a heating device that is able to heat trunnion 11 and outer ring 15 in a homogeneous and controlled manner. This device is advantageously designed to be able to be placed in active position, close to trunnion 11, in such a way as to heat the trunnion and the outer ring in a homogeneous and controlled manner and a retracted position, in such a way as to leave space for other devices and to also allow two modules to fit together.

Figure 4:
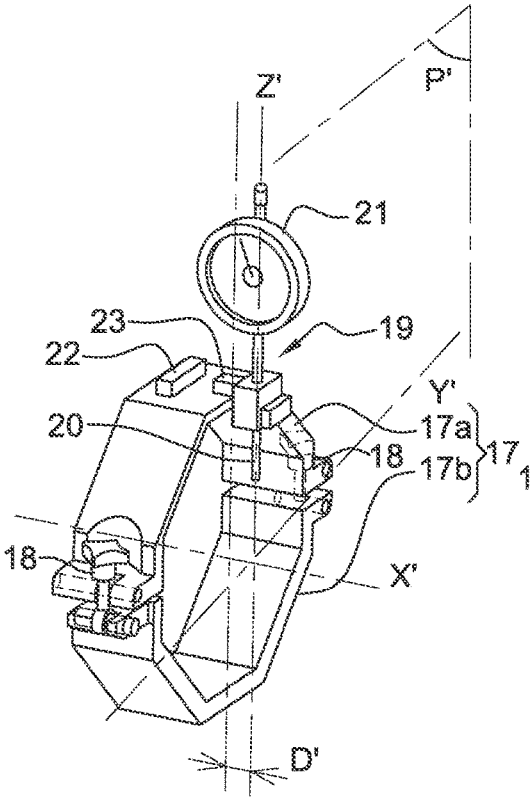
FIG. 4 shows a tool as per the invention that is used for assembly.
Figure 5:
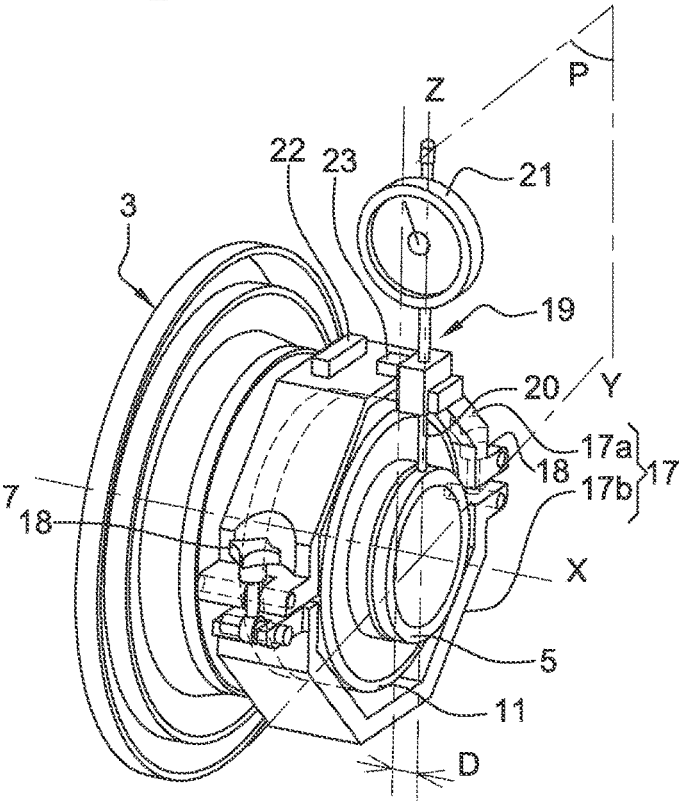
FIG. 5 shows the tool from FIG. 4 placed on the trunnion presented in FIGS. 2 and 3.

With reference to FIGS. 4 and 5, the invention more specifically concerns a tool for fine centring measurements, to be fixed to trunnion 11. Based on the example in FIG. 4, the device comprises a holding ring 17 that has an inner surface that has been dimensioned to fit snugly over the outer surface of trunnion 11. Ring 17 here is advantageously composed of two moving parts, 17*a* and 17*b*, assembled using tightening and articulation means 18 to facilitate its positioning on trunnion 11, but holding ring 17 may be formed from a different number of parts, or even just one grip. Here, the tightening and articulation means 18 comprises a hinge on one side and a bolt on the other. Tightening and articulation means 18 is preferably designed to be locked either with a notch or with a set tightening force, which allows the reproducible positioning of the device relative to trunnion 11 to be ensured.

The device also comprises a measurement system 19 which allows the position of the surface of one part to be defined relative to a radial direction Z' relative to an axis of symmetry X' for holding ring 17. For example, it is a tactile measurement system 19 which comprises a radial finger 20 with an internal end intended to rest against the surface of a part and a unit 21 which reads the position of the radial finger 20 along said radial direction Z'. The device may directly incorporate a means for checking the verticality of radial finger 20, in the form of a spirit level 22, for example. What is more, as can be seen in FIG. 4, radial finger 20 is offset from the axial end of holding ring 17 by a set distance D' along axis X', in such a way as to bring axis X' to a distance less than the inner radius of holding ring 17. What is more, the support for radial finger 20 and the measuring unit 21 on holding ring 17 may comprise a swivel joint 23. On FIG. 4, the radial finger is positioned along the radial direction Z', on the transverse plan P', ready to take a measurement. Swivel joint 23 allows pivoting around the direction Y', tangential to holding ring 17 in this location, in order to place it in a raised position, not shown on this figure, and therefore allow a part to pass through without touching radial finger 20.

With reference to FIG. 5, the device thus described may be installed on trunnion 11 by laterally introducing holding ring 17 with its two, separated, moving parts, 17*a* and 17*b*, then bringing the latter together in such a way that they rest on the outer surface of trunnion 11. The precise placing of holding ring 17 in such a way that its axis X' coincides with the X axis of trunnion 11 and that the radial measuring direction Z' corresponds with the vertical Z may be achieved using spirit level 22. The measuring finger 20 is therefore in place to measure the placement relative to the axis X of a portion of second shaft 5 that is inserted in trunnion 11, in a transverse plane P at a set distance D from the downstream end of trunnion 11, substantially equal to the value D'.

We can now describe the assembly procedure for the two modules.

A first step is known in which the docking of second module 4 with first module 3 is started by placing second shaft 5 at a set distance from trunnion 11. Second shaft 5 is positioned horizontally, parallel to longitudinal axis X of first module 3 and with its end that is to be inserted into the first shaft being presented in front of trunnion 11.

The centring step is carried out here several times, as illustrated on FIGS. 6, 7, 8 and 9.

Figure 6:
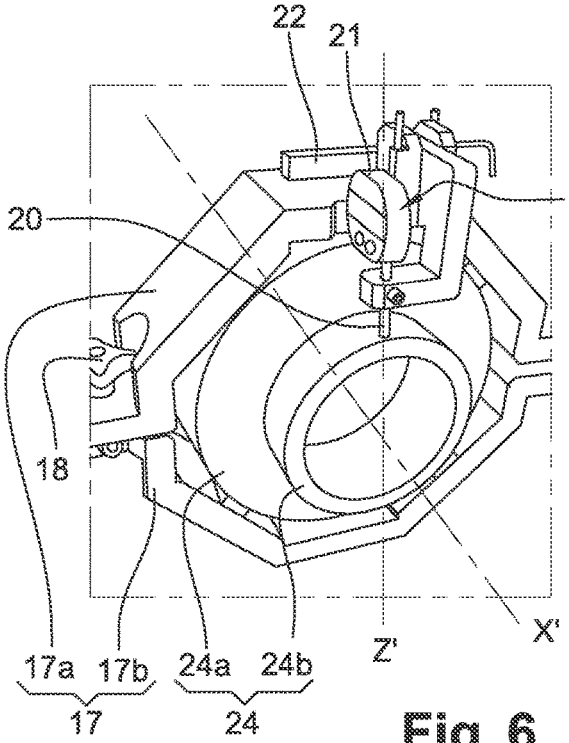
FIG. 6 shows the tool from FIG. 4 placed on a model for a calibration step.

It comprises a preliminary calibration operation for means of measurement 19, described above. As illustrated in FIG. 6, this operation uses a calibration model 24 comprising a first part 24*a* and a second part 24*b*, that respectively reproduce the geometry of the outer surface of trunnion 11 and the geometry of the outer surface of a portion of second shaft 5, exactly centred on axis X of trunnion 11. The portion of second shaft 5 is the one on which the fine centring measurements are taken during the procedure. This portion of second shaft 5 on which the measurement is taken is located upstream of inner ring 13.

As shown on FIG. 6, the tool is installed on first part 24*a* of the model during this operation in the place that it is to occupy on trunnion 11. The blocking of tightening means 18 allows it to be ensured that the tool is in place exactly as it would be on trunnion 11, by having central axis X' of the tool coincide with that for model 24. Radial finger 20 of measuring means 19 is brought into contact with the surface of second part 24*b* of the model. The measuring unit 21 is fitted in such a way as to record the position of radial finger 20 along radial direction Z', in such a way as to provide a very precise positioning reference, i.e. down to one-hundredth of a millimetre. This position is intended to be used as a reference for measuring the deviations in positioning of second shaft 5 relative to trunnion 11.

Figure 7:
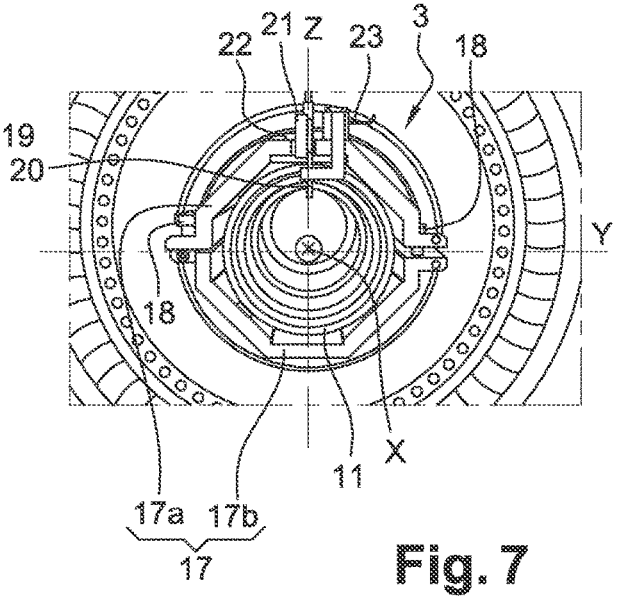
FIG. 7 shows the tool from FIG. 4 placed on the trunnion presented in FIGS. 2 and 3, equipped in such a way as to allow a shaft to be passed into the trunnion.

As can be seen in FIG. 7, the fine centring tool is then placed in position on trunnion 11 of first module 3. Spirit level 22 is used here to position radial finger 20 along vertical Z. In FIG. 7, radial finger 20 is in position for the measurement to be taken on the portion of second shaft 5 that must be checked. Swivel joint 23 is advantageously used at the end of this operation to lift radial finger 20 to allow second shaft 5 to pass without risking any damage to means of measurement 19.

These operations are presented here at this stage of the procedure, but they may be advantageously carried out prior to said first step of the procedure.

The centring step itself starts with a preliminary centring operation, during which second shaft 5 is inserted into the first shaft until the measurement portion of the second shaft appears in front of radial finger 20 of the tool. As stated above, since the internal diameter of collar 7 of the first shaft is less than the diameter of outer ring 15, the insertion of second shaft 5 may be carried out with average precision at this stage. In fact, the measuring portion on second shaft 5 is upstream of inner ring 13 of the bearing. Therefore, since the measurement portion of second shaft 5 is placed at the entrance to trunnion 11, no parts of second shaft 5, namely, inner ring 13 and rollers 14, that are likely to touch outer ring 15 or tightening bolt 16 because of their diameter, have yet passed into trunnion 11.

Figure 8:
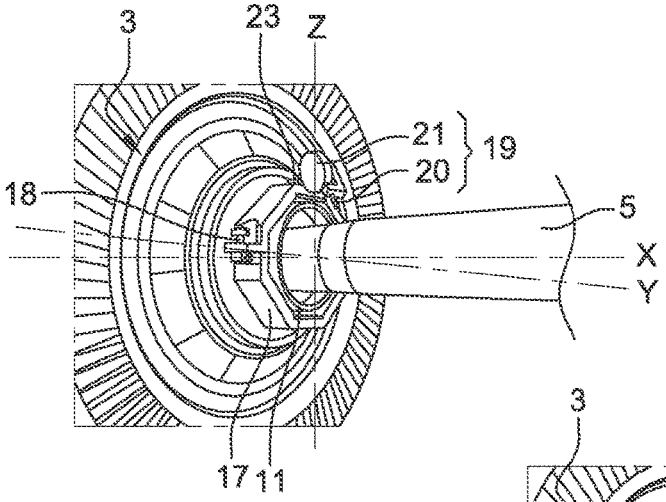
FIG. 8 shows a preliminary centring step for a shaft relative to the trunnion.

As illustrated in FIG. 8, degrees of freedom in rotation and translation of the mobile support, not shown, of module 4 for the low-pressure turbine may be used to insert second shaft 5 whilst checking the centring with simple means e.g. a rule. At the end of this preliminary centring operation, second shaft 5 is sufficiently horizontally centred, based on direction Y. However, the vertical centring, along direction Z, must be improved.

Figure 9:
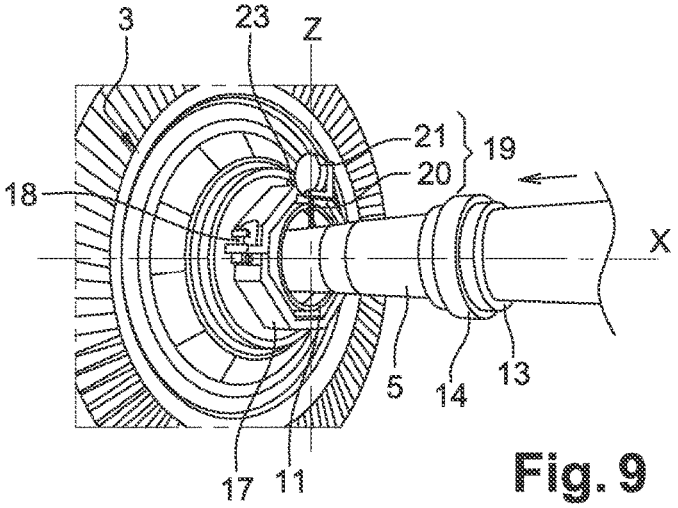
FIG. 9 shows the use of the tool from FIG. 4 to finely centre the shaft shown in FIG. 8, before the full assembly of the turbine engine.

The fine centring operation using the invention carries out said vertical centring. As illustrated in FIG. 9, the radial finger 20 is placed in the measuring position, in contact with said measuring portion of second shaft 5. Measuring unit 21 compares the position of radial finger 20 relative to the reference position measured on calibration model 24. Based on this comparison, the vertical position of module 4 of the low-pressure turbine is adjusted to eliminate the difference with the reference measured on model 24. This operation allows second shaft 5 to be centred with a significant level of precision, down to one-hundredth of a millimetre and, therefore, ensure that there will not be any hard contact when inner ring 13 with rollers 14 is inserted by translation following the arrow parallel to horizontal axis X into previously-dilated outer ring 15, not visible on the figure.

This fine centring checking operation may potentially be carried out several times, on portions of second shaft 5 with the same diameter, after successive movements of second module 4 and before inner ring 13 is introduced into trunnion 11.

At the end of the centring step, when the second module has been precisely centred, a heating step is carried out for trunnion 11, together with outer ring 15, in order to dilate said outer ring 15 and allow bearings 14 to be inserted. For this step, the fine centring tool is advantageously withdrawn, by loosening holding ring 17 from trunnion 11. A known device, as described for example in document FR-A1-2890110, is advantageously installed around the trunnion to homogeneously heat and control the assembly. This heating step stops when outer ring 15 is correctly dilated.

The docking of the two modules is then completed via translation of the second module along the longitudinal axis X, specifically to align outer ring 15 and rollers 14 on inner ring 13, to form the inter-shaft bearing and join the carter clamps for the two modules.

The invention claimed is:

1. A device for assembling a turbine engine, wherein said device comprises:

a holding ring fixed around a trunnion of a first module of the turbine engine by tightening in such a way as to have a central axis (X') of the holding ring coincide with a longitudinal axis (X) of the trunnion, and a meter supported by the holding ring and located in front of an end of the trunnion, the meter being configured to measure a position deviation along a radial direction (Z') relative to the central axis (X') and in a transverse plane (P) offset from the holding ring, said radial direction (Z') coinciding with a vertical axis (Z), wherein the holding ring comprises at least two parts movable in relation to each other to removably couple the trunnion to the holding ring, laterally, wherein the meter comprises a finger movable along said radial direction (Z'), said finger being in contact with an outer surface of a shaft of a second module of the turbine engine, to represent the position deviation via the radial position of said finger, said device being configured to vertically center the shaft of the second module relative to the longitudinal axis (X) of the trunnion, said shaft of the second module being inserted along said longitudinal axis (X) via said end of said trunnion, and wherein a spirit level is fixed on a flat upper surface of the holding ring, wherein said meter is supported by said flat upper surface of the holding ring via a swivel joint to switch the meter from a first position in which the finger is movable along the radial direction (Z'), to take a measurement, and second position in which said finger is distanced from the central axis (X') to allow the shaft to pass, wherein said finger of the meter is perpendicular to said flat upper surface of the holding ring in said first position, wherein said swivel joint comprises a support secured to said flat upper surface and an arm which is rotatable relative to said support, said meter being secured to said arm, wherein said arm comprises a vertical portion arranged between a longitudinal portion and a transverse portion, said longitudinal portion being rotatably connected to said support, said meter being secured to said transverse portion, wherein said longitudinal portion is parallel to said central axis (X'), said vertical portion being parallel to said radial direction (Z'), and said transverse portion being parallel to a transverse axis (Y'), said transverse axis (Y') being perpendicular to both said central axis (X') and said radial direction (Z'), when the meter is in said first position.

2. The device according to claim 1, wherein said device comprises a reproducible tightening means for said moving parts of the holding ring, to control the position of holding ring relative to trunnion.

3. An assembly formed of a device according to claim 1, and a calibration model comprising a first part that reproduces the geometry of the outer surface of the trunnion and a second part that reproduces the geometry of an outer surface of a cylindrical portion of the shaft, centered relative to the longitudinal axis (X) of the first part.

4. The device according to claim 1, wherein said longitudinal axis (X) and said central axis (X') are horizontal, said radial direction (Z') is vertical.

5. The device according to claim 1, wherein said flat upper surface of the holding ring is perpendicular to said radial direction (Z').

6. The device according to claim 1, wherein said flat upper surface of the holding ring is horizontal.

7. The device according to claim 1, wherein said meter is an indicator.

8. The device according to claim 1, wherein said first module is a high pressure module and said second module is a low pressure module.

9. The device according to claim 1, wherein the holding ring comprises two parts movable in relation to each other, the two parts being connected to each other by tightening and articulation means, the tightening and articulation means comprising a hinge on one side and a bolt on the other side.

10. The device according to claim 1 wherein said support is directly secured to said flat upper surface.

11. A device for assembling a turbine engine, wherein said device comprises:

a holding ring fixed around a first shaft of a first module of the turbine engine by tightening in such a way as to have a central axis (X') of the holding ring coincide with a longitudinal axis (X) of the first shaft, and a meter supported by the holding ring and located in front of an end of the first shaft, the meter being configured to measure a position deviation along a radial direction (Z') relative to the central axis (X') and in a transverse plane (P) offset from the holding ring, said radial direction (Z') coinciding with a vertical axis (Z), wherein the holding ring comprises at least two parts movable in relation to each other to removably couple the first shaft to the holding ring, laterally, wherein the meter comprises a finger movable along said radial direction (Z'), said finger being in contact with an outer surface of a second shaft of a second module of the turbine engine, to represent the position deviation via the radial position of said finger, said device being configured to vertically center the second shaft of the second module relative to the longitudinal axis (X) of the first shaft, said second shaft of the second module being inserted along said longitudinal axis (X) via said end of said first shaft, and, wherein a spirit level is fixed on a flat upper surface of the holding ring, wherein said meter is supported by said flat upper surface of the holding ring via a swivel joint to switch the meter from a first position in which the finger is movable along the radial direction (Z'), to take a measurement, and second position in which said finger is distanced from the central axis (X') to allow the shaft to pass, wherein said finger of the meter is perpendicular to said flat upper surface of the holding ring in said first position, wherein said swivel joint comprises a support secured to said flat upper surface and an arm which is rotatable relative to said support, said meter being secured to said arm, wherein said arm comprises a vertical portion arranged between a longitudinal portion and a transverse portion, said longitudinal portion being rotatably connected to said support, said meter being secured to said transverse portion, wherein said longitudinal portion is parallel to said central axis (X'), said vertical portion being parallel to said radial direction (Z'), and said transverse portion being parallel to a transverse axis (Y'), said transverse axis (Y') being perpendicular to both said central axis (X') and said radial direction (Z'), when the meter is in said first position.

12. The device according to claim 11 wherein said support is directly secured to said flat upper surface.

13. A device for assembling a turbine engine, wherein said device comprises:

a holding ring fixed around a trunnion of a first module of the turbine engine by tightening in such a way as to have a central axis (X') of the holding ring coincide with a longitudinal axis (X) of the trunnion, and a meter supported by the holding ring and located in front of an end of the trunnion, the meter being configured to measure a position deviation along a radial direction (Z') relative to the central axis (X') and in a transverse plane (P) offset from the holding ring, said radial direction (Z') coinciding with a vertical axis (Z), wherein the holding ring comprises at least two parts movable in relation to each other to removably couple the trunnion to the holding ring, laterally, wherein the meter comprises a finger movable along said radial direction (Z'), said finger being in contact with an outer surface of a shaft of a second module of the turbine engine, to represent the position deviation via the radial position of said finger, said device being configured to vertically center the shaft of the second module relative to the longitudinal axis (X) of the trunnion, said shaft of the second module being inserted along said longitudinal axis (X) via said end of said trunnion, and wherein a spirit level is fixed on a flat upper surface of the holding ring, wherein said meter is supported by said flat upper surface of the holding ring via a swivel joint to switch the meter from a first position in which the finger is movable along the radial direction (Z'), to take a measurement, and second position in which said finger is distanced from the central axis (X') to allow the shaft to pass, wherein said finger of the meter is perpendicular to said flat upper surface of the holding ring in said first position, wherein said swivel joint comprises a rotatable-arm, said meter being secured to said arm, wherein said arm comprises a vertical portion arranged between a longitudinal portion and a transverse portion, said longitudinal portion being rotatably connected to said holding ring, said meter being secured to said transverse portion, wherein said longitudinal portion is parallel to said central axis (X'), said vertical portion being parallel to said radial direction (Z'), and said transverse portion being parallel to a transverse axis (Y'), said transverse axis (Y') being perpendicular to both said central axis (X') and said radial direction (Z'), when the meter is in said first position.

* * * * *